United States Patent [19]

Haven et al.

[11] Patent Number: 4,948,292

[45] Date of Patent: Aug. 14, 1990

[54] PAVING MACHINE HAVING TRANSVERSELY AND LONGITUDINALLY ADJUSTABLE GRADE SENSORS

[75] Inventors: Matthew B. Haven, Cedar Rapids; Joseph E. Musil, Ely, both of Iowa

[73] Assignee: Cedarapids, Inc., Cedar Rapids, Iowa

[21] Appl. No.: 384,392

[22] Filed: Jul. 24, 1989

[51] Int. Cl.[5] ..... E01C 19/48

[52] U.S. Cl. ..... 404/84; 404/118

[58] Field of Search ..... 404/84, 96, 104, 114, 404/118, 119, 120

[56] References Cited

U.S. PATENT DOCUMENTS

| | | | |
|---|---|---|---|
| 3,811,787 | 5/1974 | Beaty et al. | 404/84 |
| 3,813,181 | 5/1974 | Barnes, III | 404/84 |
| 4,403,889 | 9/1983 | Gillotti | 404/72 |

*Primary Examiner*—William P. Neuder

*Attorney, Agent, or Firm*—Simmons, Perrine, Albright & Ellwood

[57] ABSTRACT

A paver of the floating screed type which is capable of operating with screed extensions for laying down pavement at various widths includes a self-contained, stowable and extensible grade reference system with a wide, planar adjustment range. The grade reference system provides an adjustment range for positioning a grade sensing device on either or both sides of the paver both forward and transversely outward from a selected support point on the paver. The grade reference system has a pivotally outer support member which permits the sensing device to become positioned at any selected setting of an arcuate path forward of a rearward position in substantial alignment with the leading edge of the screed to a forward position determined by the length of the member. The pivotal adjustment range of the outer support member is augmented by a transverse adjustment range effected by an extension or retraction of a corresponding support member to shift the pivot axis of the outer support member respectively outward or inward. The combination of the two adjustments provides for a mix of anticipatory grade change sensing combined with laterally outward extensions of the screed beyond the full extension range of the screed.

12 Claims, 2 Drawing Sheets

FIG 1
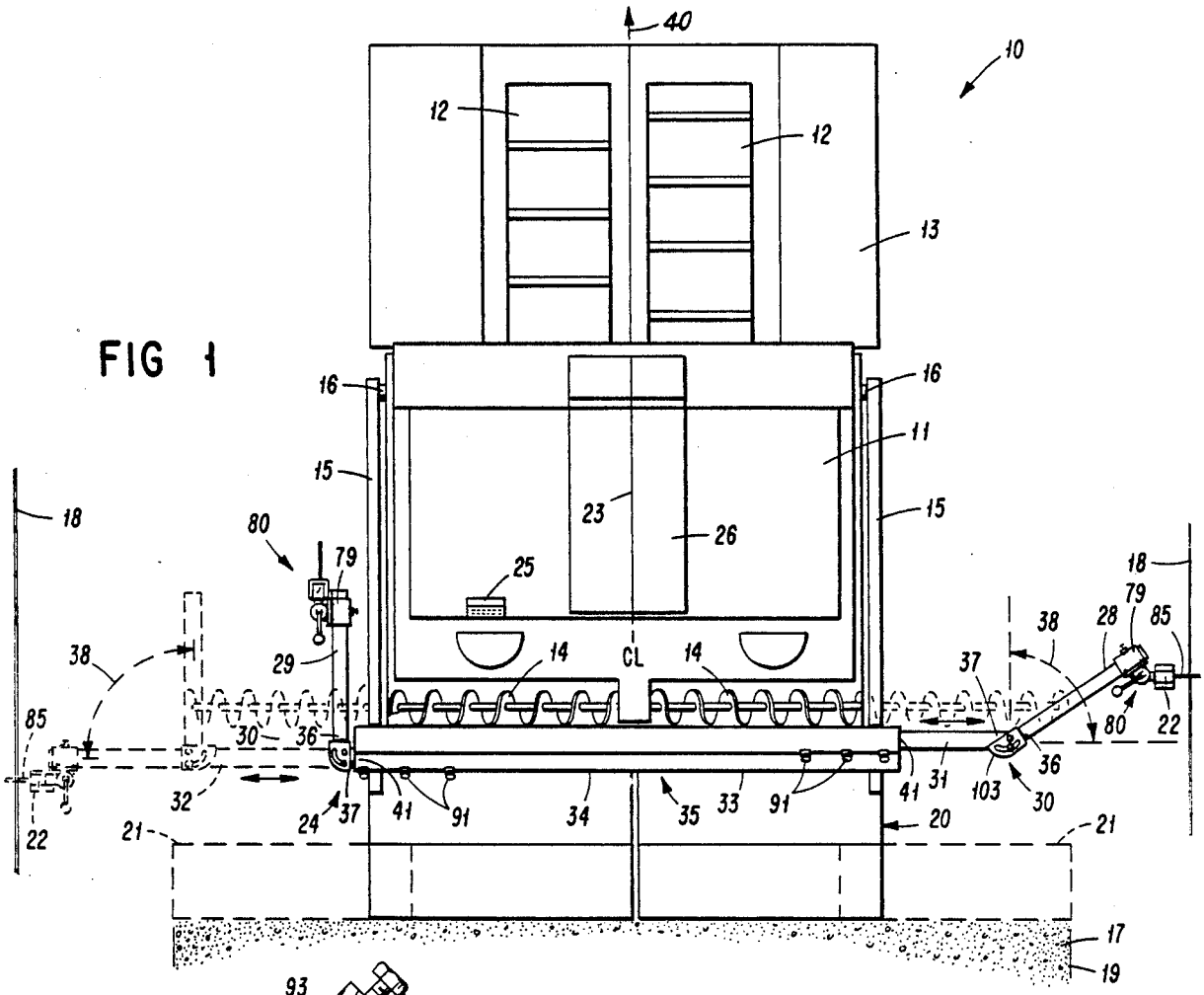
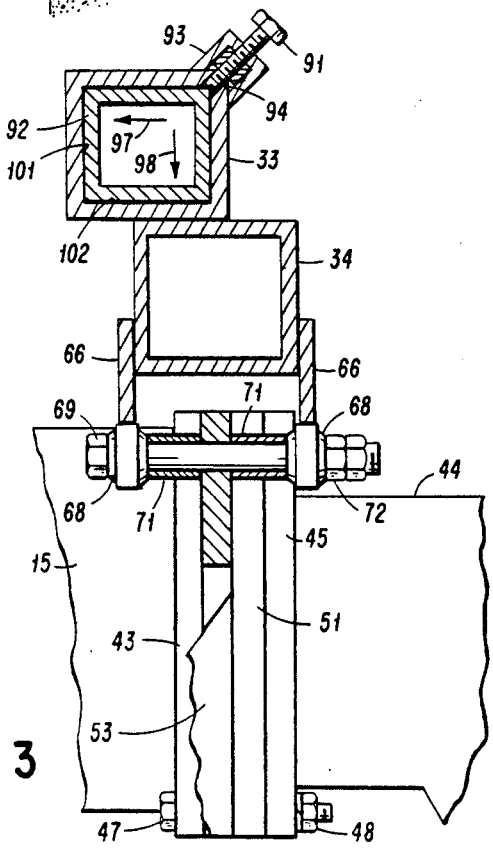
FIG 3
FIG 4
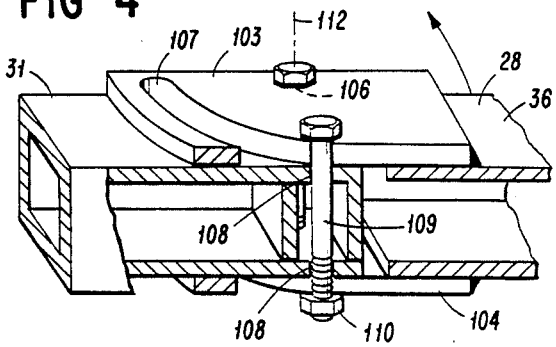
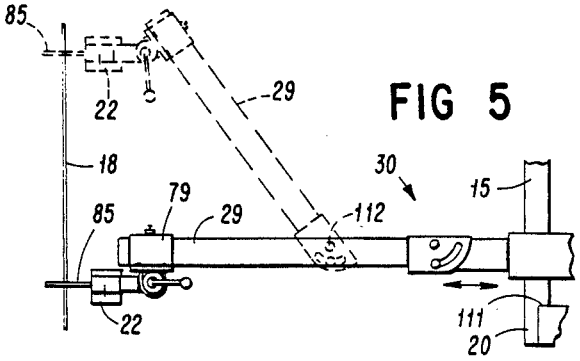
FIG 5

PAVING MACHINE HAVING TRANSVERSELY AND LONGITUDINALLY ADJUSTABLE GRADE SENSORS

BACKGROUND OF THE INVENTION

1. Field of the Invention

The invention relates generally to pavers, such as, for example, asphalt pavers used in continuous paving operations for long strips of pavement, such as on highways, airport runways, parking lots and the like. More particularly, the invention relates to grade reference systems which are instrumental in controlling the grade of the paved surfaces.

2. Description of Related Art

All pavements designed particularly for vehicles moving at high speeds typically include controlled transverse slopes to assure proper water run-off. Grade controls to assure compliance to surveyed grades along the lengths of pavement strips are equally important for pavements used for high speed operations, such as interstate highways and airport runways. Straight runs are particularly important with respect to airport runways. Highways require smooth transitions from straight runs into ascending or descending grades. A particular problem in the prior art relates to effectively mounting grade reference sensors on pavers using screed extensions to enable the pavers of laying down pavement of various widths. Accordingly, state of the art pavers have the capabilities to effectively more than double their standard paving widths by the use of screed extensions.

Typically, the use of screed extensions brings about a need to position grade reference systems outward with respect to the centerline of the paver using the screed extensions. For example, typical grade sensors make reference to and indicate deviations from one of various types of surveyed grade references, such as direct sensing of an existing grade by a sensing shoe, by referencing to a string line on a travelling ski, or to string lines which are strung off to the sides of the path of the paver to indicate the surveyed grade of the pavement. Thus, the grade reference sensor necessarily has to be adjusted outward from the centerline of the paver, as the paving width of the paver is increased by additions to the screed.

According to a current practice, the grade sensors are usually supported by the front part of the pull arms by which the screed of the paver is pulled along, such front part being near the pull point through which the pulling force of a tractor is transmitted to the screed. A grade sensor positioned near the screed receives only attenuated deviation indications of upcoming grade changes. With substantially no anticipatory grade change indications, transitions from one indicated grade to another tend to be more abrupt, as some floating screeds may be slow to react to grade changes, the actual grade change may lag the desired grade. Abrupt changes are likely to be undesirable for paving highways or runways designed for handling high speed traffic. For an anticipation of a grade change and a smoother transition from one grade to another, the grade sensors are preferably mounted somewhere intermediate the front and rear ends of the pull arms.

The forward ends of the pull arms present no particular difficulty for mounting support arms of standard length for grade sensors. Such standard support arms would be applicable when the paver is used without screed extensions and the grade reference line is located about three feet laterally away from the pull arm. When the paver is used with screed extensions, however, supporting the grade sensors becomes more difficult. The difficulty results from the lack of a support base for attaching the cantilevered length of the support needed to position the grade sensors laterally outside of the width to be paved. The forward ends of the rear pull arms are typically located laterally on both sides of the tractor unit. Up to now, long extensions for supporting the grade sensors have had to be strengthened by, for example, overhead braces which were attached at their base ends to the superstructure of the tractor unit. Frequently more than one length of extension and its respective brace may be needed to provide the proper support for grade control sensors suspended at different widths. The grade sensor supports may, consequently, present a substantial inventory of accessory hardware, all of which may need to be held in readiness at job sites. Maintaining the readiness of the additional extensions and braces adds to the cost of paving operations.

Also, it has been recognized that a grade reference sensing position just ahead of the screed offers a more positive control over transverse changes between opposite sides of the screed than a grade reference sensing position near the pull point of the screed pull arm on the tractor. A sensing position referenced substantially to the screed will give a continuous indication of the position of the screed to the grade reference, hence the string line. If the quality of a paving job is to be judged by the accuracy to which the paver lays the pavement to the grade reference, an anticipatory grade change away from the current string line reference is undesirable.

On the other hand, a sensor location on the pull arms near the screed has been found to be sensitive to lateral flexing of the pull arms during the paving operation. Such flexing about longitudinal axes of the pull arms is particularly noticeable when the screed is adjusted for a "crown", such that the center of the screed is raised with respect to its ends.

It is therefore desirable to overcome problems that relate to shifting of a grade sensor because of a flexure of a pull arm, to accommodate extensible screeds and resulting transverse shifts in the location of grade reference lines, and to provide adaptability to changes in requirements and to achieve a balance between response to anticipatory grade changes and maintaining an optimum degree of control over screed elevation with respect to a string line or similar grade reference.

SUMMARY OF THE INVENTION

According to the present invention a grade reference system of a paving machine includes a pivotally mounted support arm member carried by a screed pull arm intermediate the rear and forward ends of the screed pull arm. The support arm member pivots about a pivot axis through an arc in a horizontal plane from an extended position transverse to the direction of travel of the paving machine to a forward pivoted position in such direction of travel. The outer end of the support arm member includes mounting provisions for a grade sensor. An arc of pivotal adjustment of the support arm member permits the grade sensor to become located at a selected position ahead of the front end of a screed assembly in the rear of the paving machine. The pivot axis of the support arm member is adjustable transversely to the paving machine for lateral outward or inward adjustments of the grade sensor with respect to the centerline of the paving machine.

One particular aspect of the invention includes two of the support arm members each of which is pivotally attached at its pivot axis to one of a pair of support arms. Each of the support arms is slidably mounted in a guide extending substantially across the width of the paving machine, which guides prevent rotational movement of the support arms about their respective longitudinal axes. Locking provisions selectively inhibit movement of the support arms along their longitudinal axes to prevent inadvertent change from an adjusted position of the support arms.

The outer arm members of the support arms are mounted for pivotal movement in a horizontal plane between their extended positions transversely to the longitudinal centerline of the paving machine to forward pivoted positions to locate the respective grade sensors forward of the support arm guide and increase a sensitivity to anticipatory grade changes.

An advantage of the grade reference system in accordance with the invention is the ability to stow those lengths of the support arms which are in excess of a proper needed length, and to immediately have the maximum lengths of the support arms available at the paving machine when a maximum paving width is desirable. In a fully retracted position of the support arms, the outer support arm members may be pivoted forward into a folded retracted position adjacent the respective pull arms to facilitate movement of the paving machine between job sites.

Another advantage of the invention is found in a wide support base for the cantilevered extension of the support arms which tends to stabilize the outer support arm members and impart rigidity to the grade reference system. Since the outer support arm members are furthermore pivotally movable over a range of pivoted positions between a straight extension and a forward position when the support arms are fully extended, an optimum forward position may be combined with an optimum extended position.

BRIEF DESCRIPTION OF THE DRAWINGS

Various advantages and features of the invention will be best understood when the following detailed description of a preferred embodiment thereof is read in reference to the appended drawings wherein:

FIG. 1 is a schematic top view of a paving machine including a screed assembly and screed extensions thereof, and a grade reference system and illustrating among other features extensible support arms including contemplated positions within a preferred range of movement of outer support arm members, as contemplated by the present invention:

FIG. 3 is a section through the support assembly of the grade reference system, taken in a direction of the arrows as indicated by "3—3" in FIG. 2;

FIG. 4 is a section through the support assembly and particularly through a pivot joint of the outer support arm members of the support arms, showing details of the pivot joint; and FIG. 5 is a partial schematic plan view of the extensible grade reference system showing alternate positions of a support arm member including a position for anticipatory grade change sensing in accordance with the invention.

DETAILED DESCRIPTION OF THE INVENTION

The Paver

Figure 2:
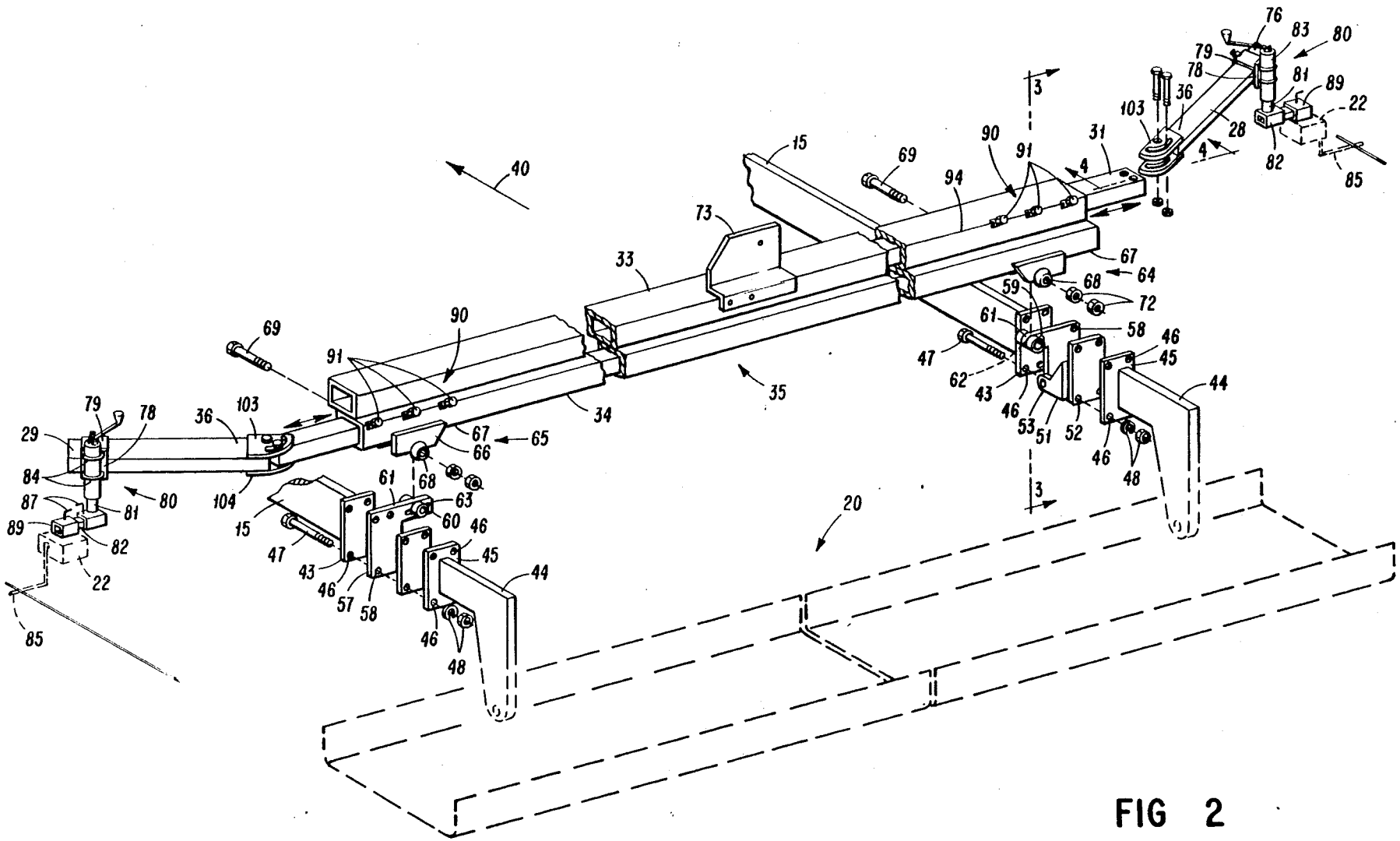
FIG. 2 is a pictorial view of a support arm assembly shown apart from a mounted position on a paving machine and on a larger scale to show further details of the support arm assembly.

Referring to FIG. 1, there is shown a bituminous paving machine or "paver", which is designated generally by the numeral 10. The paver 10 illustrated and broadly described herein is an example of apparatus to which the present invention advantageously applies and which is improved in its operation by features of the invention. The paver 10 includes generally a tractor unit 11 centrally through which dual feed conveyors 12 carry paving material, such as asphaltic material, from a feed hopper 13 located at the front of the paver 10 towards its rear. Spreader augers, also referred to as spreading screws 14, are disposed transversely to and at the rear of the tractor unit 11 adjacent rear portions of two parallel screed pull arms 15 the front ends of which are pivotally supported at respective pull points 16 on each side of the tractor unit 11. The spreading screws 14 distribute the asphaltic material transversely to the direction of travel of the tractor unit 11. The material is spread over the desired width of a strip of pavement 17 and is struck off at a desired level prior to being compacted. A surveyed grade reference, such as a string line 18 is typically stretched just outside of an outer edge or boundary 19 of the strip of pavement 17 to denote the specified grade of the pavement 17. The actual grade of the pavement 17 becomes established by a material-compacting, floating screed, a screed assembly being designated generally by the numeral 20. Consequently, the relationship of the height or vertical position of the bottom of the screed 20 with respect to the string line 18 establishes the correctness of the grade of the pavement 17. The screed 20 is attached to the rear of the pull arms. The angle at which the screed 20 floats on the asphaltic mix is, in addition to other slope adjustments of the screed 20, steadied and maintained by the angle of the pull arms 15. Other changes such as transverse slope changes in the screed 20 can be achieved by changing the angle of one side of the screed 20 with respect to the other. Such techniques are well known and are typically applied in paving operations. Because of the mounting of the screed 20 to the rear portions of the pull arms, the distance between the rear of the pull arms 15 and the bottom of the screed remains in theory fixed, and varies, for example, because of typical tolerances in the equipment, such as play in the pull arms 15 which play allows twisting about the longitudinal axes of the pull arms.

U.S. Pat. No. 4,702,642 to Musil pertaining to an extensible screed assembly, such as the screed assembly 20, describes in detail functions and the operation of such a screed assembly including adjustments to achieve various operating widths of the screed, as may be obtained by screed extensions 21, as shown in FIG. 1. As a result of width adjustments in the screeds for changing the width of the pavement 17, the distance of the string line 18 from the center of the intended pavement 17 is correspondingly extended to remain undisturbed by the paving operation. In further reference to FIG. 1, the positions of grade sensors 22 with respect to the paver 10 are similarly adjustably mounted to become located adjacent the string line 18 at various distances from a centerline 23 of the paver 10. An extensible grade reference system or grade sensor support structure 24, located at the rear of the tractor unit 11, provides the support for making adjustments to the grade sensors 22. Control over the operation of the paver 10 is typically exercised from a control console 25 which is typically located in the rear of the tractor 10 just ahead of the screed 20 and on either side of the centerline 23 of the paver 10. Screed controls are typically located directly on the screed 20 and are serviced by a person other than the person controlling the paver 10. In general, control tasks may include monitoring automatic grade reference controls. The controls also include steering controls and power controls regulating the forward motion of the paver 10. The paver 10 is typically powered by an engine 26 located along the centerline 23 of the paver 10 between the feed hopper 13 and the screed 20. In that screed control functions are typically semi-automatic or fully automatic, a primary control function is steering the paver 10 and monitoring contact by and proper adjustment of the grade sensors to the grade reference, such as the string line 18.

The Support Arm Assembly

To achieve adjustments of the sensors 22 into vertical alignment with the current location of the string line 18, the sensors 22 are pivotally mounted to outer ends of outer support arm members 28 and 29 of a support arm assembly 30, which outer support arm members 28 and 29 are themselves pivotally mounted at their respective inner ends. FIG. 1 shows a preferred arrangement and location of the support arm assembly 30 and the cooperative relationship of the components thereof. Right and left support arms 31 and 32 extend from right and left hand support tubes 33 and 34, respectively. The right support tube 33 is disposed above and offset toward the front of the paver 10 with respect to the left support tube 34. The support tubes 33 and 34 are disposed to preferably coincide with their respective lengths and are permanently joined to each other, such as by welding, so as to form a unitary structure referred to as support tube assembly 35. The offset disposition of the support tubes 33 and 34 does not affect the transverse adjustment range of the grade sensor 22. The resulting vertical offset between the right and left outer support arm members 28 and 29 can be compensated for as further explained below in reference to FIG. 2. Consequently, in spite of the offset disposition of the support tubes 33 and 34, the support arms 31 and 32 and the outer support arm members 28 and 29 may be of the same length and can be of reversible construction, if so desired. Outer support arm members 28 and 29 are pivotally attached at inner pivot ends 36 to respective outer ends 37 of the right and left support arms 31 and 32 to be preferably pivotable through an arc 38 of approximately a right angle in a substantially horizontal plane from an extended position transverse to the paver 10 to a fully pivoted position pointing forward in the direction of travel of the paver.

In designating structural members as right, left, front or rear members, it should be noted that these designations are made in reference to the forward direction of travel of the paver 10 as indicated by an arrow 40. In general, positioning adjustments of the support arm assembly 30 will be similar on both sides of the paver 10, unless reference to the string line 18 is made on only one side of the paver 10 and the elevation of the pavement on the other side is controlled by a typical slope controller. Differences in adjustments, as described with respect to the drawings, and alternate positions shown, illustrate ranges of possible adjustment and advantages derived thereby.

The support tubes 33 and 34 are preferred to be as long, or longer by only a nominal length for clearances and assembly tolerances, as a respective width across the pull arms 15. The support arm assembly 30 is mounted to the pull arms 15 in a centered position with respect to the paver 10, such that ends 41 of the support tubes 33 and 34 from which the respective support arms 31 and 32 extend are located just beyond the respective pull arms 15 Thus, when for example, the support arms 31 and 32 are fully retracted into the respective support tubes 33 and 34, the respective outer support arm members 28 and 29 may be pivoted forward for storage to become disposed adjacent and just to the outside of the pull arms 15, as shown by the forward pivoted position of the support arm member 29 in FIG. 1. In such a pivoted position of the outer support arm members 28 and 29, a grade reference directly adjacent the screed pull arms 15 may be also be sensed.

The manner in which the support arm assembly 30 of the preferred embodiment is mounted to the paver 10 is best described in reference to FIG. 2. Rear portions 42 of the pull arms 15 terminate in rear mounting plates 43 which are disposed substantially perpendicular to the lengths of the pull arms 15 Each of two L-shaped brackets or pivot arms 44 has at a forward end thereof a pivot arm mounting plate 45 which is rigidly attached to the respective pivot arm 44 perpendicular to the major surface thereof. The mounting plates 43 and 45 have aligned apertures 46 which permit the pivot arms 44 to be removably attached to the respective rear portions 42 of the pull arms 15. The removable attachment is achieved by inserting and fastening bolts 47 through the apertures 46 in a typical manner with appropriate mounting hardware 48 In the attached position the pivot arms 44 effectively become longitudinal extensions of the respective pull arms 15. The ability of detaching the pivot arms 44 from the pull arms 15 permits the removal of the screed 20 from the tractor unit 11 without the need to disassemble major portions of the screed 20. FIG. 2 further shows screed lift brackets 51 which have apertures 52 in alignment with the apertures 46 to become, in the described embodiment, sandwiched between the respective mounting plates 43 and 45. Each of the two screed lift brackets 51 has an apertured lift lug 53 as an integral part thereof. One end of a conventional lift device (not shown) such as a hydraulic cylinder or a screw jack may be attached to the lift lug 53 with the other end of the lift device being attached to the paver 10, to raise the screed 20 with respect to the paver 10 away from the surface of the pavement 17. Such lifting is convenient, for example, to maneuver the paver 10 from or into paving positions between paving operations. In a manner similar to the screed lift brackets 51, right and left support arm assembly mounting brackets 56 and 57 are sandwiched between the mounting plates 43 and 45 preferably ahead of the screed lift brackets 51. The mounting brackets 56 and 57 feature apertures 58 aligned with the apertures 46 in the respective mounting plates for admitting the bolts 47 therethrough. The mounting brackets 56 and 57 feature respectively inwardly extending mounting ears 59 and 60 along their upper edges 61. The ear 59 features a mounting aperture 62, while the ear 60 has a mounting slot 63 which is horizontally disposed with respect to the upper edge of the respective mounting bracket 57.

The lower, left support tube 34 of the support tube assembly 35 has right and left sets 64 and 65 of mounting lugs 66 welded to a lower edge 67 thereof. Each of the mounting lugs 66 holds a pivot bearing 68, each two of which in the respective set 64 or 65 are axially aligned, as shown in the sectional view of FIG. 3. The aligned pivot bearings 68 admit a mounting bolt 69 to mount the support arm assembly 30 to the mounting brackets 56 and 57 and, hence, to the pull arms 15. The bolt 69 is inserted through the pivot bearings 68 and through spacers 71 on either side of the respective mounting ear 59 or 60, as is shown in the sectional view with respect to the mounting ear 60. Two jam nuts 72 are threaded onto the end of the bolt 69 and are tightened against each other to hold the bolt snugly, yet not tightly. With the jam nuts 72 properly adjusted and tightened, the spacers 71 steady the support arm assembly 30 vertically on the mounting ears 59 and 60. Still, a sliding clearance allows the bolt 69 to slide within the slot 63 and the pivot bearings 68 to pivotally relieve bending- and transverse stresses. Such stresses would in case of a clamped mounting be transmitted to the support arm assembly 30 as the B result of twists or transverse movements of the pull arms 15. Such twists or transverse movements are likely to cause positional changes of the support arm assembly 30. Any positional changes would be amplified by the extending outer support arm members 28 and 29 and the grade sensors 22 mounted thereto, possibly causing unwanted screed adjustments and defects in the pavement 17. A snug but not tight adjustment of the nuts 72 on the mounting bolts 69 tends to minimize such stress transmission. On the upper surface of the upper, namely the right support tube 33 of the support tube assembly 35, a slope control mounting bracket 73 (see FIG. 2) provides an alternate attachment base as a possible mounting location, if so desired, for a slope sensor box (not shown). On prior art apparatus, such a slope sensor box is typically mounted on an overhead frame supported on both sides by respective screed pull arms.

It should be understood that the attachment of the support arm assembly 30 to the pull arms 15 by means of the sandwiched mounting brackets 56 and 57 represents a particular embodiment of the invention. Other mounting arrangements are contemplated, such as attaching mounting brackets with functions similar to the mounting brackets 56 and 57 to the top or to inner or outer surfaces of the pull arms 15. However, even when such changes are contemplated, a stress relieving mounting arrangement as described herein above is deemed desirable to achieve certain advantages of the preferred embodiment. The manner in which the support arm assembly 30 is supported vertically with respect to the pull arms 15 allows the outer support arm members 28 and 29 to pivot substantially in a horizontal plane. However, it should be realized that the orientation of such plane depends on the angle of the pull arms with respect to the horizontal. Under typical operating conditions the screed pull arms 15 are considered to be disposed substantially horizontal. Thus, when reference is made to the substantially horizontal plane through which the outer support arm members move, the orientation of the plane is understood to be in reference to the pull arms 15.

In reference to FIG. 2, the outer support arm members 28 and 29 carry at respective outer ends 76 and 77 support plates 78 rigidly mounted to clamping sleeves 79. The clamping sleeves 79 are slidably adjustable along the respective lengths of the support arm members 28 and 29 to be clamped rigidly into a desired position thereon. A standard grade sensor mounting assembly 80 is attached to the support plates 78. Typically, the sensor mounting assembly 80 includes a vertical sensor support 81 which supports at its lower end a horizontal sensor support 82. The vertical sensor support 81 typically includes vertical and vertically pivotal or axially rotational adjustment provisions with respect to the outer support arm member. Such provisions, shown as a jack screw 83 and releasable U clamps 84 in FIG. 2, permit the horizontal sensor support 82 to be adjusted for proper alignment of the grade sensor 22 such that a sensor element 85 of the sensor 22 becomes centered on the string line 18, as shown in FIG. 1. Precise inward or outward adjustments of the sensor element 85 are made possible, for example, by a corresponding extension or retraction of the horizontal sensor support 82, which adjustments are retainable by tightening of typical clamping screws 87, for example, which retain the sliding extension members 89 of the grade sensor mounting assembly 80.

Support Arm Extension

Each of the support tubes 33 and 34 has a clamping arrangement 90 of three clamping screws 91 which are located adjacent and at preferred spaced intervals inward from the open extension end 41 of the respective support tube 33 or 34. The outer cross-sectional shape of the support arms 31 and 32 is preferably complementary to the inner cross-sectional shape of the support tubes 33 and 34, though providing a sliding clearance between the respective outer and inner surfaces. In the preferred embodiment, the crosssectional shape of the support tubes 33 and 34 and the respective cross section of the support arms 31 and 32 are of square shape. The extension ends 41 slidingly receive inner end portions 92 of the support arms 31 and 32. While the clamping screws 91 are not tightened, the support arms 31 and 32 are freely adjustable inward and outward over the range described herein.

The clamping arrangement 90, once engaged, restrains the support arms 31 and 32 from further inward or outward movement, and also references the orientation of the support arms 31 and 32 with respect to the orientation of the support tubes 33 and 34. In the preferred embodiment, clamps 91 are spaced by a distance of six inches from each other. Also, the first one of the clamping screws 91 is set back from the respective end by some distance, for example three inches, allowing an effective clamping base for each clamping screw 91 of three inches to each side of the application point of the screw. Thus, each set of the three clamping screws 91 clamps down a length of approximately twenty four inches of the respective support arms 31 and 32.

As illustrated by the sectional view of FIG. 3, the clamping screws 91 are threaded into the respective support tube, such as shown with respect to the support tube 33 in FIG. 3, through standard threaded fasteners which are part of and held within nut cages 93. The nut cages 93 are welded to an edge 94 of the respective tube at a preferred angle of forty five degrees from the orthogonal axes of the support tube assembly 35. The clamping action described with respect to the support tube 33 and the right support arm 31 is also applicable to the left support tube 34 and the respective left support arm 32. When the clamping screws 91 are threaded into the tube 33 to engage the support arm 31 at the preferred angle, the resulting tightening force, resolved into horizontal and vertical force components 97 and 98, respectively, presses the support arm 31 against inner vertical and horizontal reference surfaces 101 and 102 of the respective tube 33. The respective support arms 31 or 32 are consequently supported rigidly over a base of twenty four inches, provided such a length of the support arms remain in engagement with the support tubes 33 or 34.

In regard to the amount of extension of the support arms 31 and 32, twenty four inches is preferred to be the minimum engagement distance of the support arms 31 and 32 with the support tubes 33 and 34. The described clamped distance provides the base for the extension of the support arms 31 and 32, the outer support arm members 28 and 29, and the respective grade sensor mounting assemblies 80 as described above. In a particular embodiment the support arms 31 and 32 have preferred lengths of 120 inches and the respective outer support arm members 28 and 29 have a preferred length of thirty six inches. A maximum contemplated extension of the support arms 31 and 32 is, consequently, approximately eighty percent of the length of the support arms. Extension of the support arms 31 and 32 is achieved by loosening the clamping screws 91, adjusting the length of extension of the support arms as needed and retightening the clamping screws. The support arms 31 and 32 are similarly easily retracted into the respective support tubes 33 and 34. The retraction of the support arms 31 and 32 stores the support arms, yet affords availability for any job of the paver that may require an extension of the grade sensors 22 outward from a close sensing position. An extension of the support arms 31 and 32 may be desirable even when no screed extensions are used. For example, surface interference may require a string line 18 temporarily to be placed further than normal from the paver 10.

The Outer Support Arm Member

FIG. 4 shows in greater detail a preferred pivotal hinging and position locking arrangement for the outer support arm members 28 and 29. Upper and lower pivot plates 103 and 104 are welded to the inner ends 36 of the arm members 28 and 29, the arm member 28 being shown in FIG. 4. Each of the pivot plates 103 and 104 has a pivot aperture at 106 and an arcuate pivot slot 107 with a center of curvature at the pivot aperture 106. The centers of the pivot apertures 106 on the plates 103 and 104 are in vertical alignment defining a vertical axis about which the arm members 28 and 29 will pivot. The corresponding support arm 31 has two through holes 108 adjacent its outer end 37 and transverse to the length of the support arm. The pivot aperture 106 and pivot slot 107 are aligned with the through holes 108 and bolts 109 extend therethrough to complete the attachment of the outer support arm members 28 and 29 to the support arms 31 and 32. The bolts are tightened with nuts 110. To adjust the angle of the support arm members 28 and 29, the bolts 109 are loosened and retightened after the adjustment. Tightening in particular the bolt 109 inserted through the pivot slot 107 locks in the pivotal adjustment of the outer support arm member.

In a paving operation, the outer support arm members 28 and 29 carrying the grade sensor mounting assemblies 80 may be pivoted from a forward, stored position to a partially extended position, such as, for example, through a pivot angle of forty five degrees from the forward position, to align the grade sensor 22 with the grade reference, such as the string line 18 as described above. The length of the outer support members of thirty six inches is preferred, in that a pivoted position provides substantially for a full extension of the support arm assembly 30 and still provides for a forward positioning of the sensor 22 for an anticipatory grade change indication.

FIG. 5 illustrates an adjustment support arm assembly 30 to increase or decrease the responsiveness of the grade sensors 22 to anticipatory grade changes. In a first adjusted position of the support arm assembly 30 the outer support arm member 29 is pivoted transversely to the direction of travel of the paver 10. The grade sensor mounting assembly positions the sensor 22 substantially at the leading edge 111 of the screed 20, at which the sensor element 85 will be adjusted to a fixed distance above the base of the screed. Thus in the extended position, the sensor element will be insensitive to changes in the angle of the pull arms 15. Such changes may occur from inaccuracies in the pavement base or as a result of the grade of the base having changed because of an upcoming grade change. In case of inaccuracies it is desirable to correct the angle of the pull arms 15 before the floating screed changes the grade angle in the direction of travel of the paver. Because of the floating characteristic of the screed 20, such a grade angle change would typically precede an actual grade change. By the time the grade sensor 22, located directly at the screed senses a deviation of the screed 20 with respect to the string line 18, the screed may already be well into a grade change. Even though corrective adjustments may bring an immediate return of the screed level with respect to the string line 18, the imperfection already may have been embedded into the pavement 17.

The alternate position of the outer support arm member 29, pivoted about axis 112, positions the grade sensor 22 toward the front of the tractor unit 11 and away from the leading edge of the screed 20. The alternate position consequently decreases the responsiveness of indication to the grade of the screed 20 with respect to the grade reference, such as the string line 18, but causes instead the grade sensor 22 to register changes in the angle of the pull arms 15 as deviations of the screed 20 away from the string line 18, even though at that moment the screed may still be at an ideal grade level with respect to the string line 18. The registered deviation is used by typical state of the art pavers to effect an angle correction of the pull arms 15 in a direction to maintain the current grade being paved by the screed 20. On the other hand, when a grade change occurs, before the screed 20 adjusts to the new grade, the angle of the screed needs to change correspondingly. Because of the width of the base of the floating screed 20, the screed needs to have moved at least some distance past the current paving position before the angle of the screed 20 can have changed. An anticipatory grade change, sensed by the forward, alternate position of the sensor 22, permits such a change in the angle of the screed in time that the pavement is compacted at the changed angle when the screed 20 has reached the forward position of the string line or other grade reference at which the change in grade was first detected.

The support arm assembly 30 provides for an adjustment range of approximately the length of the outer support arm members 28 and 29 to determine an optimum forward adjustment position for the grade sensor 22 to provide a mix of anticipatory grade control indications in conjunction with the grade reference indications for an optimum adjustment of the smoothness of the pavement 17.

The above description of the invention in reference of a preferred embodiment thereof does bring to mind various changes and modifications possible without departing from the spirit and scope of the invention. It should be realized, for example, that an extensible grade reference system, such as disclosed herein, is frequently used only on one side of a paving machine. Consequently, a structure which provides an extensible grade reference system to only one side of a paving machine may still be considered to lie within the scope of the present invention. It is also expected, that various models and makes of pavers similar to the paver 10, yet differing in structural details, may require a mounting structure which differs somewhat from the structure for mounting the support tube assembly 35. Instead of employing sandwiched support arm assembly mounting brackets 56 and 57, brackets including ears, similar to the ears 59 and 60 may be permanently or removably mounted to the tops or sides of pull arms. Also, various grade references are used and grade sensors change accordingly. The extensible grade reference sensor mounting structure may consequently include any of various sensors for sensing string lines or direct grades without affecting the spirit and scope of the invention.

Other changes and modifications are possible within the spirit and scope of the claimed invention.

What is claimed is:

1. A grade reference system for a paving machine, the paving machine being of the type including a tractor unit, a screed assembly disposed across the rear of the tractor unit, and a pair of laterally spaced screed pull arms attached to the screed assembly and extending from the screed forward along the outside of the tractor unit and being pivotally supported at the forward ends of the screed pull arms at a screed pull point on each side of the tractor unit, the grade reference system comprising:

means for supporting a grade sensor on at least one side of the tractor unit with respect to the screed pull arms and intermediate between a leading edge of the screed assembly and the screed pull point, the grade sensor supporting means including means for pivotally adjusting the position of the grade sensor in a substantially horizontal circular path of a predetermined radius about a vertical pivot axis over a range between an extended position from the pivot axis transversely outward from a centerline through the tractor unit and screed assembly and a pivoted position forward of the pivot point by the distance of the predetermined radius; and means for adjusting the position of the pivot axis transversely of the centerline through the screed assembly.

2. A grade reference system according to claim 1, wherein the grade sensor supporting means comprises:

at least one support arm having inner and outer ends, the outer end of the support arm including at least one set of apertures defining a vertical axis therethrough;

at least one outer support arm member having inner and outer ends, the inner end including means defining a vertical pivot axis;

means for pivotally attaching the outer support arm member to the support arm with the vertical pivot axis in alignment with the vertical axis of the support arm; and means for supporting the at least one support arm transversely of and with respect to the screed pull arms to extend to at least one side thereof

3. A grade reference system according to claim 2, wherein the at least one support arm is first and second support arms, wherein the at least one outer support arm member is first and second outer support arm members, the first outer support arm member being pivotally attached to the first support arm, and the second outer support arm member being pivotally attached to the second support arm, the first support arm extending to one side of the pull arms and the second support arm extending to the other side.

4. A grade reference system according to claim 3, wherein the means for adjusting the position of the pivot axis comprises a pair of support tubes of non-circular interior cross-sectional shape, each support tube being disposed adjacent and in parallel with the other support tube and having an open extension end at an end opposite to the extension end of the other support tube, means for securing the support tubes transversely across the screed pull arms, and wherein each of the first and second support arms has a non-circular external cross-sectional shape complementary to the internal cross-sectional shape of one of the support tubes, the first and second support arms having a predetermined length between inner and outer ends, the inner end being slidably insertible into the extension end of the one of the support tubes, such that each of the support tubes slidably receives a respective one of the support arms, the outer end thereof protruding beyond the respective extension end to position the pivot axis transversely of the screed assembly centerline.

5. A grade reference system according to claim 4, wherein the means for adjusting the position of the pivot axis further comprises means located on each of the support tubes adjacent the extension ends thereof for clamping the support arms against inner walls of the respective support tubes and adjustably restraining further movement of the support arms in the longitudinal direction thereof upon adjustment of the pivot axis transversely of the screed assembly centerline.

6. A grade reference system according to claim 5, wherein the non-circular cross sectional shapes of the support tubes and the respective support arms are square cross-sectional shapes, and wherein the support tubes are disposed in vertical contact with each other and are rigidly joined to each other forming a unitary structure, and wherein the means for securing the support tubes transversely across the screed pull arms comprises a support attached to each of the screed pull arms, mounting lugs attached to the support arms in two sets spaced adjacent opposite ends of the support tubes by the distance of the spacing of the supports attached to each of the screed pull arms, and means joining one of the sets of mounting lugs to a respective one of the supports attached to the screed pull arms for vertically supporting the support tubes on the supports attached to the screed pull arms and for providing clearance for movement of the supports attached to the screed pull arms with respect to each other and transversely of the centerine through the screed 7. Apparatus according to claim 4, wherein the non-circular cross sectional shapes of the support tubes and the respective support arms are square cross-sectional shapes, and wherein the means for adjusting the position of the pivot axis further comprises a plurality of threaded fasteners and nut cages, the nut cages rigidly joined to a longitudinal edge of each of the support tubes adjacent and at spaced intervals coincident with a plurality of apertures through the longitudinal edge and inward from the extension ends of the support tubes and at an angle of forty five degrees from orthogonal axes of the support tubes, and a plurality of clamping screws corresponding to the plurality of threaded fasteners and nut cages, each one of the clamping screws threaded into a respective one of the nut cages and extending inwards therethrough for engaging the inner ends of the respective support arms to urge the support arms against inner walls of the support tubes, thereby restraining further movement of the support arms with respect to the support tubes and establishing an extended adjustment thereof.

8. A paving machine of the floating screed type having a tractor unit, a screed assembly disposed transversely across the rear of the tractor unit, and a pair of laterally spaced screed pull arms pivotally supported adjacent their forward ends on respectively opposite sides of the tractor unit and connected adjacent their rear ends to the screed assembly, wherein the improvement comprises: a grade reference system including:

at least one extensible support arm having an inner and and an outer end;

means for mounting the support arm relative to and for extensible and retractive movement substantially horizontally and transversely of the screed pull arms intermediate the forward and rear ends of the screed pull arms to move the outer end of the at least one support arm respectively away from and toward the screed pull arms;

means for retaining the at least one support arm relative to the screed pull arms in a selected extended position;

at least one support arm member having a predetermined length with opposite ends;

means for pivotally supporting a first end of the at least one support arm member on the outer end of the at least one support arm, for pivotal movement of said support arm member over a range from a laterally extended position at which a second end of said outer support arm member is disposed with respect to the first end thereof, in a substantially horizontal direction, transversely to the direction of travel of the tractor unit and adjacent a lateral projection of a leading edge of the screed assembly, and a pivoted position wherein the second end is disposed with respect to the first end substantially forward in the direction of travel of the tractor unit., means for securing the support arm member in a selected postition within the range of pivotal movement; and means for securing a grade sensor to the support arm member on the outer support arm member.

9. The paving machine according to claim 8, wherein the means for securing a grade sensor to the support arm member is slidably adjustable along the length of the outer support arm member between first and second ends of the outer support arm member.

10. The paving machine according to claim 8, wherein the at least one extensible support arm comprises right and left support arms, and the means for mounting the support arms comprises means for mounting each of the support arms, each support arm being mounted to extend, respectively, to the right and left sides of the tractor unit, and wherein the at least one outer support arm member comprises right and left outer support arm members, each being pivotally supported at the outer end of the respective right and left support arms.

11. The paving machine according to claim 10, wherein the means for mounting each of the support arms comprises right and left support tubes slidably receiving at respective extension ends thereof the inner ends of the right and left support arms, respectively, the support tubes and support arms having a non-circular, complementary cross section, the shape of the cross section preventing rotation of the support arms within the respective tubes, and wherein the means for retaining the at least one support arm relative to the screed pull arms comprises a clamping means adjacent the respective extension ends of the right and left support tubes for clamping the support arms against inner walls of the support tubes 12. The paving machine according to claim 11, wherein the right and left support tubes are offset in the longitudinal direction of the paving machine and are rigidly joined to each other, wherein the clamping means adjacent the respective extension end of each support tube comprises a plurality of clamping bolts for urging and referencing the support arms against inner walls of the support tubes, and wherein the means for mounting each of the support arms further comprises means disposed transversely opposite on each of the screed pull arms for securing the support tubes to each of the screed pull arms, the securing means including means for relieving the support tubes of stress due to transverse motion of the screed pull arms with respect to each other.

* * * * *